United States Patent [19]

Liebert et al.

[11] 4,213,390

[45] Jul. 22, 1980

[54] REMOTE-CONTROL ADJUSTMENT RETROFIT SYSTEM FOR AN INK SUPPLY IN A PRINTING MACHINE

[75] Inventors: Oskar Liebert; Michael Wörner, both of Neusäss, Fed. Rep. of Germany

[73] Assignee: Maschinenfabrik Augsburg-Nurnberg Aktiengesellschaft (M.A.N), Augsburg, Fed. Rep. of Germany

[21] Appl. No.: 944,586

[22] Filed: Sep. 21, 1978

[30] Foreign Application Priority Data

Oct. 4, 1977 [DE] Fed. Rep. of Germany ... 7730668[U]

[51] Int. Cl.[3] ..... B41F 31/02

[52] U.S. Cl. ..... 101/365

[58] Field of Search ..... 101/365, 366, 148, 364; 192/142 R

[56] References Cited

U.S. PATENT DOCUMENTS

| | | | |
|---|---|---|---|
| 3,044,314 | 7/1962 | Klingler | 101/365 X |
| 3,134,325 | 5/1964 | Worthington et al. | 101/365 |
| 3,330,393 | 7/1967 | Heimlicher | 101/365 |
| 3,696,743 | 10/1972 | Johne et al. | 101/365 |
| 3,727,550 | 4/1973 | Easoz et al. | 101/365 |
| 3,730,090 | 5/1973 | Lamberg et al. | 101/365 |
| 3,747,524 | 7/1973 | Crum | 101/365 |
| 3,771,447 | 11/1973 | Easoz | 101/365 |
| 3,792,659 | 2/1974 | Albrecht | 101/365 |
| 3,820,459 | 6/1974 | Paul | 101/365 |
| 4,051,782 | 10/1977 | Fernandez | 101/365 |

FOREIGN PATENT DOCUMENTS

| | | | |
|---|---|---|---|
| 341272 | 9/1921 | Fed. Rep. of Germany | 101/365 |
| 2125288 | 5/1971 | Fed. Rep. of Germany | 101/365 |
| 2814889 | 10/1978 | Fed. Rep. of Germany | 101/365 |

*Primary Examiner*—Eugene H. Eickholt

*Attorney, Agent, or Firm*—Frishauf, Holtz, Goodman & Woodward

[57] ABSTRACT

An elongated carrier or holder 11, in the form of an elongated, hollow channel profile, is screwed to the frame 2 of the printing machine. The carrier 11 is formed with a long slot 15 through which clamping bolts 17, 18, attached to clamping plates 16 internally of the channel 11, can pass. The clamping bolts clamp individual supports 19 to the channel, adjustable longitudinally of the machine and up and down since the slot is wider than the side of the bolts, the supports each carrying a synchronous motor 27, and a gear train 26, 24 meshing with gear 23 attached to the adjustment screws 7. A stop 28 prevents excessive travel. The connecting cable for the motors is located within the channel.

9 Claims, 2 Drawing Figures

Figure 1:
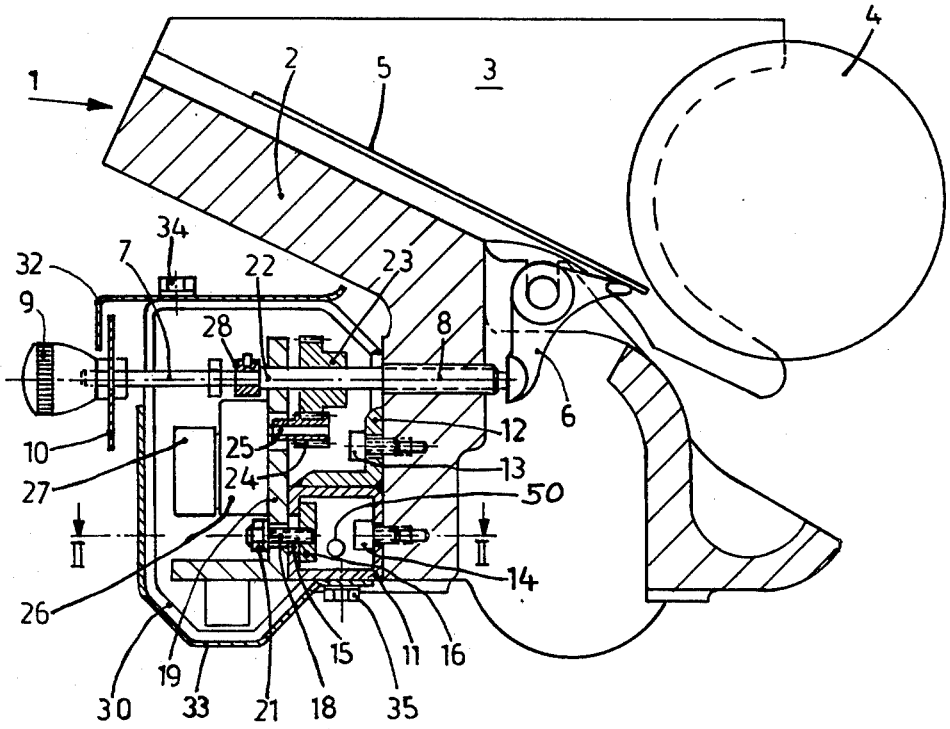

REMOTE-CONTROL ADJUSTMENT RETROFIT SYSTEM FOR AN INK SUPPLY IN A PRINTING MACHINE

The present invention relates to printing machines, and more particularly to the ink supply system therefor, and especially to an arrangement which permits automatic, remote-control adjustment for the engagement position of a doctor blade on a printing ink roller.

BACKGROUND AND PRIOR ART

Adjustment arrangements for a doctor blade which extends transversely across an ink trough to apply printing ink to an ink roller are well known. Usually, these adjustment arrangements include adjustment screws which pass through threaded openings in the trough or a holder for the printing ink.

Arrangements of this type have been described in the literature, see, for example, German Pat. No. 341,272, and are in daily use. They require manual adjustment of the various adjustment screws. It has also been proposed to provide a remote-control arrangement to adjust the screws by means of motor control—see, for example, U.S. Pat. No. 3,330,393. A control console controls an electric motor which, by means of adjustment screws and gear coupling-which, under emergency conditions can be manually operated—and coupled to the adjustment screws which engage the doctor blade, to adjust the position of the doctor blade in respective zones with respect to the ink roller. The arrangement described in U.S. Pat. No. 3,330,393, for example, is an integral part of the machine. It is not possible to add such a remote control system to an existing printing ink supply arrangement which, originally, was intended for manual operation. The ink zone screws are commonly journalled with the adjustment shafts in a common housing. Consequently, the lateral distances of the various adjustment screws are predetermined and cannot be matched to the distances of the adjustment screws, where they are threaded through the housings of the respective troughs in various types and makes of printing machines.

THE INVENTION

It is an object to provide an arrangement which permits retrofitting an existing printing machine with manual adjustment screws to be operable by remote control, while utilizing the existing equipment, as far as possible, and requiring a minimum of modification of the existing machine, which is versatile, and adaptable to practically any type or make of printing machine having an ink trough with a doctor blade.

Briefly, a plurality of supports are provided, each having a separate bearing means journalling a cylindrical portion of the adjustment screws. Gears are coupled to the adjustment screws and electric motors are provided, one for each adjustment screw, secured to the respective support. A gear train is in driving connection between the motor and engageable with the respective gear of the respective adjustment screw and of the motor. Individually adjustable attachment means are provided attaching the supports to the frame. Preferably, the individually adjustable attachment means is a rail or channel element which is slotted so that the position of the motors and the gear trains can be varied along the length of the slot, the inside of the rail having a clamping bar located therein so that the motors and gear trains can be individually placed with respect to the adjustment screws, wherever they may be on the specific machine being retrofitted. The channel can then serve as an electrical conduit for the cables connected to the motors, individual connections for individual motors being fished through the slot.

The arrangement provides a reliable, trouble-free connection between motors and adjustment screws, is simple, can be easily electrically controlled and is reliable since no clutches are provided between the motors and respective screws, which may slip or go out of adjustment. Small adjustment motors and gear trains are inexpensive items of mass production.

A particularly simple arrangement for the gear train is obtained if the gear has a shaft which extends parallel to the longitudinal axis of the ink doctor blade adjustment screw, and a pinion is secured to the adjustment screw which meshes with a pinion on the shaft forming part of the gear train.

Preferably, clamping screws are provided which engage a clamping bar inside of the channel, passing through the slot therethrough. Accurate adjustment of the individual motors is thus easily possible. The channel itself can be attached to the machine by a few bolts, requiring only the drilling of a few holes into the machine frame and tapping the holes to receive the bolts to attach the channel. Accurate adjustment of the individual motors and gear trains with respect to the position of the existing doctor blade adjustment screws can then be done by the clamping bolts extending through the adjustment slot.

Figure 2:
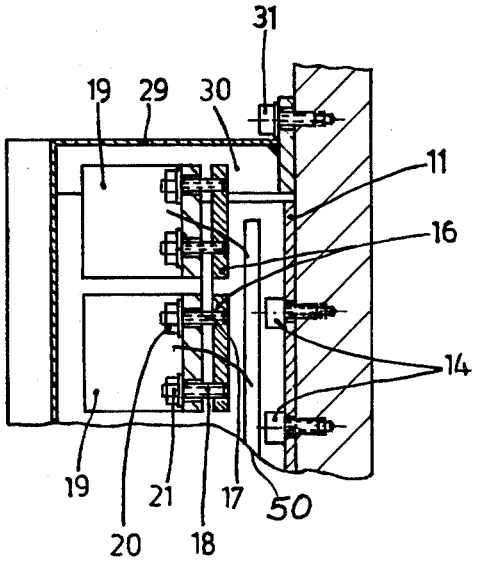

Drawings, illustrating a preferred example, wherein:

FIG. 1 is a transverse cross section through a standard ink trough and illustrating the adjustment screws for the doctor blade, and further showing the retrofit attachment connected to the ink trough; and FIG. 2 is a fragmentary longitudinal cross section, showing one end of the retrofit attachment along line II—II of FIG. 1; the other end can be a mirror image.

The ink trough, ink roller and doctor blade can be of any known construction and is already present on the machine. The ink trough 1 has an ink trough housing 2 having lateral walls 3, of which only one is seen. An ink roller 4 is suitably journalled in the ink trough. A doctor blade 5 can be engaged with the ink roller 4. The nip between the doctor blade 5 and the ink roller 4 is adjustable by means of an adjustment lever 6 which is pivotably journalled in the trough 1. One end of lever 6 engages the doctor blade 5, the other end is engaged by an ink doctor blade adjustment screw 7. A plurality of such adjustment screws 7 are located axially along the length of the machine to provide uniformity of the nip between blade 5 and roller 4 and prevent bowing of the blade 5.

Adjustment of the screw 7 is effected by rotating the screw. The screw 7 is tapped as seen at 8, fitting in a suitable thread in the housing 2 of the ink trough. The screw can be manually rotated and has an adjustment knob 9 with a scale disk 10 secured thereto at its free end. This portion of the ink trough, doctor blade and nip adjustment is one embodiment of a standard arrangement well known in connection with manually adjustable screws.

In accordance with the present invention, the screws 7 can be remotely adjusted or controlled, without otherwise substantially interfering with the construction of the machine or requiring extensive modifications.

A closed channel element 11, for example having essentially square or rectangular cross section, has a connecting L-bracket welded thereto. The L-bracket has holes placed therethrough along its length to permit screws 13 to be passed therethrough to attach the L-bracket, and hence the channel 11 to the frame 2 of the machine. The holder or carrier 11, formed by the channel structure, extends transversely across the entire range of the ink trough throughout which adjustment screws 7 are provided. The channel 11 is formed with a longitudinal slot 15 at the vertical side remote from the side provided for engagement with the frame 2. Clamping rails or clamping strips 16 are located inside the holder or channel 11. Each clamping rail or strip 16 has the inner ends of two attachment bolts 17, 18 secured thereto, for example by threading the bolts into tapped openings of the rails or strips 16 and securing them by an adhesive, such as epoxy. Other attachment arrangements can be used, although, in a preferred form, the inner outline of the trough 11 preferably should be essentially free from obstructions to prevent damage to electrical cables, as will appear. The diameter of the bolts 17, 18 is less than the width of the adjustment slot 15, to permit both vertical adjustment as well as longitudinal adjustment along the length of the slot. An electrical cable 50 is located in the interior of the trough 11 and may be held by suitable spacers as well known in the electrical cabling field.

The free ends of the adjustment clamping bolts 17, 18 pass through bores in a holder bracket 19. Each ink adjustment screw 7 has an individual holder 19 associated therewith. Nuts 20, 21 are screwed on the bolts 17, 18 to permit adjustment of each individual holder bracket or support bracket 19, both longitudinally as well as laterally with respect to the channel 11. The adjustment slot 15 permits individual adjustment of the support brackets 19 with respect to the channel 11, and thus with respect to the housing or frame 2 of the ink trough.

Each support 19 has a bearing for a cylindrical portion 22 formed on the adjustment screws 7. A gear pinion 23 is secured to each individual adjustment screw 7, the pinion 23 engaging a matching pinion 24, journalled on a stub shaft 25, which enters a reduction gearing 26, secured to the support 19 and, in turn, in driving engagement with a motor 27. Electric motor 27, preferably a synchronous motor, and the gearing 26 which may be associated therewith, are securely attached to the bracket portion of the support 19. A stop ring 28 is secured to each screw 7 which prevents excessive travel of any one ink adjustment screw 7 inside the trough, thus pivoting the lever 6 to such an extent that the doctor blade 5 engages the ink roller 4 with excessive engagement pressure.

The channel holder 11 has end walls 29 and a frame 30 secured thereto, the end wall and frame being attached by means of screws 31 to the housing 2 of the ink trough. Frame 30 is used additionally to secure a top lid 33, attached thereto by screws 34, 35.

Assembly to an existing machine

Before attaching the remote positioning unit, the existing screws 7 are removed. The holder 11 is placed against the frame 2, and holes are drilled to receive bolts 13, fitting the holes predrilled in the L-bracket 12. The inner wall of the channel 11 preferably is also formed with holes through which screws 14 can be passed. Holes to receive screws 14 are likewise drilled into the frame. Access is provided through the slot 15, since support 19, at this stage of the assembly, is removed. The drilled holes are tapped, and the channel 11 is attached to the frame 2 by means of the screws 13, 14, 31. Thereafter, the strips or rails 16 are introduced from the side into the channel 11. The bolts 17, 18 are already secured thereto. The ink adjustment screws 8, to which the pinions 23 have been attached, are then screwed through the respective holes, and support 19 passed over the bolts 17, 18 and receiving the cylindrical portion of the screws 7. The nuts 20, 21 are loosely attached, and the supports 19 are then adjusted for free rotation of the screws 7 and proper engagement of the pinion 23 with the pinion 24 on the support 19. When the supports 19 are properly adjusted, nuts 20, 21 are tightened. Finally, the side walls 29 through which the strips 16 have been introduced are attached and screws 31 are tightened. Stops 28 are adjusted and tightened on screws 7, and the manual adjustment knob 9 can be clamped thereon. Finally, the lid 32 and the bottom cover 33 are attached to the frame 30 by screws 34, 35.

If the ink trough is of substantial axial extent, a plurality of frame members 30 may be provided, staggered axially, to provide for suitable support of the respective lid and bottom covers 32, 33.

The retrofit arrangement permits remote control of the respective adjustment screws by suitable energization of the respective motors 7. The meshing gear train 26 - 24 - 23 then will provide for individual adjustment of the position of the doctor blade in respective adjustment zones. The arrangement permits easy replacement or exchange of any motor which might be damaged or burned out, without requiring disassembly of the entire structure, or of supports 19 securing adjacent motors. It is only necessary to remove the nuts 20, 21, remove the electrical connection to the motor (not shown, and standard), the stop 28 and knob 9 and disk 10 and the respective support 19 with the motor and gearing 27, 26 attached thereto can be removed. In case of failure of any one of the motors, the respective screw 7 can be manually adjusted by means of knob 9, so that the arrangement is fail-safe. The particular setting of any one of the screws, whether adjusted by hand or remotely, can be read off scale 10.

Various changes and modifications may be made within the scope of the inventive concept.

We claim:

1. Remote control retrofit adjustment system for an ink supply in a printing machine, to control the relative position of a doctor blade (5) and an ink roller (4), and in which the frame (2) of the printing machine supports a plurality of adjustment screws (7) threaded in the frame and effective against the doctor blade to adjust its position with respect to the roller, comprising, in accordance with the invention, a plurality of supports (19), each having bearing means journalling a cylindrical portion (22) of one of the adjustment screws (7);

gear means (23) operatively connected to each adjustment screw;

an electric motor (27) secured to a respective support;

a gear train (26, 25, 24) in driving connection with the motor (27) and engageable with a respective gear means (23) of the associated adjustment screw (7);

and individually adjustable attachment means (15, 16, 17, 18, 20, 21) attaching each support (19), individually adjusted, to the frame (2).

2. System according to claim 1, wherein the attachment means include an elongated rail-like holder (11) having means (12, 13, 14) fixedly attaching the holder to the frame (2) of the printing machine, and adjustable means (15, 16, 17, 18, 20, 21) for attachment of individual supports (19) to said elongated rail-like holder at the positions of the adjustment screws as determined by the printing machine.

3. System according to claim 2, wherein the elongated rail-like holder is a hollow, elongated channel element (11) formed with an elongated longitudinal slot (15), the attachment means including clamp bolt means passing through said slot for individual adjustable attachment of said supports to the channel element.

4. System according to claim 1, wherein the gear train (26) includes a shaft (25) extending in parallel relation to the adjustment screw (7);

a drive pinion (24) is secured to the shaft;

and wherein the gear means (23) on the adjustment screw include a pinion secured thereto in gearing engagement with said drive pinion.

5. System according to claim 1, further including an elongated holder means (11) formed with at least one elongated slot (15) therein extending essentially parallel to the ink roller (4) of the printing machine;

and the attachment means include clamping bolts (16, 17, 18, 20, 21) of lesser size than said slot (15) for adjustable attachment of the support (19).

6. System according to claim 5, wherein the elongated holder means comprises a channel element (11) having means (12, 13, 14) for fixed, secure attachment to the frame (2);

and all the supports (19) are adjustably and removably attached to said channel element (11).

7. System according to claim 6, further comprising electrical connecting cable means (50) located within the channel element and having connecting leads individually connected to the individual motors (27) secured to the individual supports (19) for adjustably driving the individual adjustment screws (7) through said gear train (23, 24, 25, 26).

8. System according to claim 7, wherein said adjustment slot (15) extends essentially over the entire length of said elongated channel element forming the holder means (11);

the clamping elements comprise clamping screws (17, 18) having a diameter less than the width of said adjustment slot (15);

and individual clamping strips or plates (16) located within the channel element (11), the clamping bolts (17, 18) being attached to said clamping strips or plates and extending through said slot, the clamping bolts having a diameter less than the width of said slot;

the supports (19) having bores therein receiving said clamping bolts;

and clamping nuts (20, 21) threaded on said clamping bolts and clamping holding the supports (19) in individually adjustable position against said elongated channel element.

9. System according to claim 1, further including frame elements (30) located at least at the outside and adjacent the terminal - with respect to the axial extent of inking cylinder (4) of the supports (19);

and top, bottom and side cover means (29, 32, 33) attached to said frames, said frames being secured to the frame (2) of the printing machine.

* * * * *